US007278839B2

(12) United States Patent
Liu et al.

(10) Patent No.: US 7,278,839 B2
(45) Date of Patent: Oct. 9, 2007

(54) MULTI-STAGE VACUUM PUMP

(75) Inventors: Ming-Hsin Liu, Hsinchu (TW); Hong-Sheng Fang, Hsinchu (TW); Tean-Mu Shen, Hsinchu (TW); Jung-Chen Chien, Jhubei (TW); Jiun-Hung Chen, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 744 days.

(21) Appl. No.: 10/766,216

(22) Filed: Jan. 29, 2004

(65) Prior Publication Data

US 2005/0089424 A1 Apr. 28, 2005

(30) Foreign Application Priority Data

Oct. 23, 2003 (TW) ..... 92129419 A

(51) Int. Cl.
*F03C 2/00* (2006.01)
*F03C 4/00* (2006.01)

(52) U.S. Cl. ..... 418/9; 418/75; 418/104; 418/140; 418/201.1; 418/206.1

(58) Field of Classification Search ..... 418/9, 418/201.1, 206.1, 206.6, 75, 200, 104, 140
See application file for complete search history.

(56) References Cited

U.S. PATENT DOCUMENTS

| | | | | | |
|---|---|---|---|---|---|
| 599,648 | A | * | 2/1898 | Stoner | 418/9 |
| 3,198,120 | A | * | 8/1965 | Little, Jr. | 418/9 |
| 3,667,874 | A | * | 6/1972 | Weatherston et al. | 418/9 |
| 4,789,314 | A | * | 12/1988 | Higuchi et al. | 418/9 |
| 5,674,051 | A | * | 10/1997 | Maruyama | 418/201.1 |
| 6,123,526 | A | * | 9/2000 | Chen et al. | 418/9 |

* cited by examiner

*Primary Examiner*—Theresa Trieu
(74) *Attorney, Agent, or Firm*—Rabin & Berdo, P.C.

(57) ABSTRACT

A multi-stage vacuum pump includes a plurality of casings connected in series and each casing defining a respective compression chamber, a plurality of partition plates each set in between each two casings. When compressed by rotors at shafts in one compression chamber, compressed air passes through the air path formed in the corresponding partition plate to the next compression chamber for further compression, and finally compressed air passes to the last compression chamber through the air path formed in the last partition plate. Because the invention is designed to let compressed air directly pass through the air path in each partition plate, the outer diameter and volume of the multi-stage vacuum pump can be minimized to reduce the weight and the manufacturing cost.

7 Claims, 7 Drawing Sheets

MULTI-STAGE VACUUM PUMP

BACKGROUND OF THE INVENTION

1. Field of the Invention

The present invention relates to a vacuum pump and, more particularly, to a multi-stage vacuum pump, which has a small outer diameter and reduced volume and weight and, which is inexpensive to manufacture.

2. Description of Related Art

Regular equipment for clean manufacturing process, for example, equipment for depositing process, etching process, ion implanting process in semiconductor manufacturing commonly use a vacuum system to provide a proper vacuum environment for operation.

In the aforesaid vacuum system, a vacuum pump is used to achieve the desired vacuum effect. Therefore, the quality of the vacuum pump determines the achievement of the vacuum system.

FIG. 1 is a sectional view of a multi-stage vacuum pump according to the prior art. According to this design, the multi-stage vacuum pump 9 is comprised of a plurality of casings 911~915 and a plurality of partition plates 921~924 axially alternatively arranged in a stack. FIG. 2 is an exploded view of one pump unit of the multi-stage vacuum pump 9. FIG. 3 is a sectional view of the assembly of FIG. 2. As illustrated, the pump unit comprises a casing 914, which defines a compression chamber 904 and an air path 900 extended around the compression chamber 904 and adapted to guide compressed air from the compression chamber 904 to a next compression chamber 903 (see FIG. 1) for a next compression operation, a partition plate 924 covering the compression chamber 904, two shafts 931 and 932 arranged in parallel and extended through the partition plate 924, and two rotors 933 and 934 respectively formed integral with the shafts 931 and 932 and meshed together in the compression chamber 904 and adapted to compress air in the compression chamber 904.

As illustrated in FIGS. 2 and 3, the air path 900 is formed in the wall thickness of the casing 914 around the compression chamber 904. The presence of the air path 900 greatly increases the diameter and volume of the casing 914. Due to this drawback, the size and weight of the multi-stage vacuum pump 9 cannot be reduced to the desired level.

Therefore, it is desirable to provide a multi-stage vacuum pump, which eliminates the aforesaid drawbacks.

SUMMARY OF THE INVENTION

It is the main object of the present invention to provide a multi-stage vacuum pump, which has reduced outer diameter and volume. It is another object of the present invention to provide a multi-stage vacuum pump, which has a reduced weight to lower the manufacturing cost. According to one aspect of the present invention, the multi-stage vacuum pump is comprised of a plurality of casings, a plurality of partition plates, a mover module, and a synchronizer gear module. The casings are axially connected in series, each defining a compression chamber inside thereof. The partition plates each having a predetermined wall thickness, and each respectively mounted between two adjacent casings of the casings to separate the compression chambers of the two adjacent casings. Each partition plate has two through holes. The mover module comprises two parallel shafts respectively extended through the two through holes of each of the partition plates, and a plurality of rotors symmetrically formed integral with the two parallel shafts respectively and arranged in pairs, wherein each pair of two adjacent rotors of the rotors received in one corresponding compression chamber of the casings for compressing air. The synchronizer gear module adapted to rotate the shafts and the rotors synchronously.

The main feature of the present invention is the design of the partition plates. Each partition plate has a front face, a rear face, and at least one air path respectively formed in the respective wall thickness and extended from the front face to the rear face. During operation, air is compressed by the corresponding rotors in the compression chamber in one casing, and the corresponding compression chamber forms a high-pressure zone. Compressed air immediately passes through the air path of the corresponding partition plate into the next compression chamber for further compression. When compressed air passed out of the compression chamber of one casing into the compression chamber of another casing, the antecedent compression chamber is changed from a high pressure status into a low pressure status. Thereafter, air in the next compression chamber is compressed by the corresponding rotors and forced to pass through the air path of the next partition plate to another next compression chamber. When repeatedly compressed in different compression chambers, finally compressed air flows out of the air outlet of the last casing. Because compressed air directly passes through the air path in each partition plate unlike the conventional design of having compressed air to pass through the air path extending around the border area of each casing, the outer diameter and volume of the multi-stage vacuum pump can greatly be reduced to relatively lower the weight and manufacturing cost of the multi-stage vacuum pump.

DETAILED DESCRIPTION OF THE PREFERRED EMBODIMENT

Figure 1:
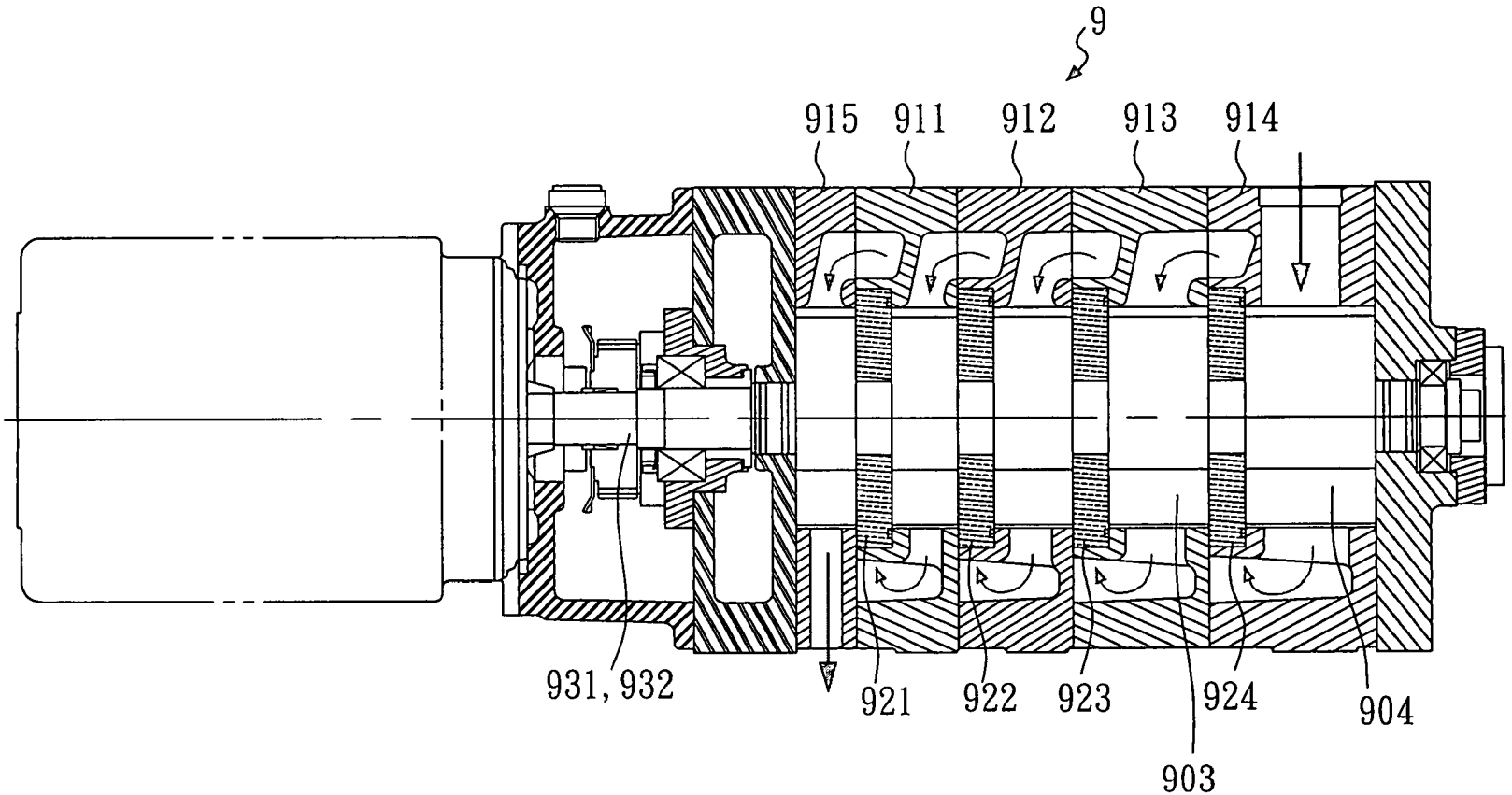
Fig. 1(Prior Art)
FIG. 1 is a sectional view of a multi-stage vacuum pump according to the prior art.
Figure 2:
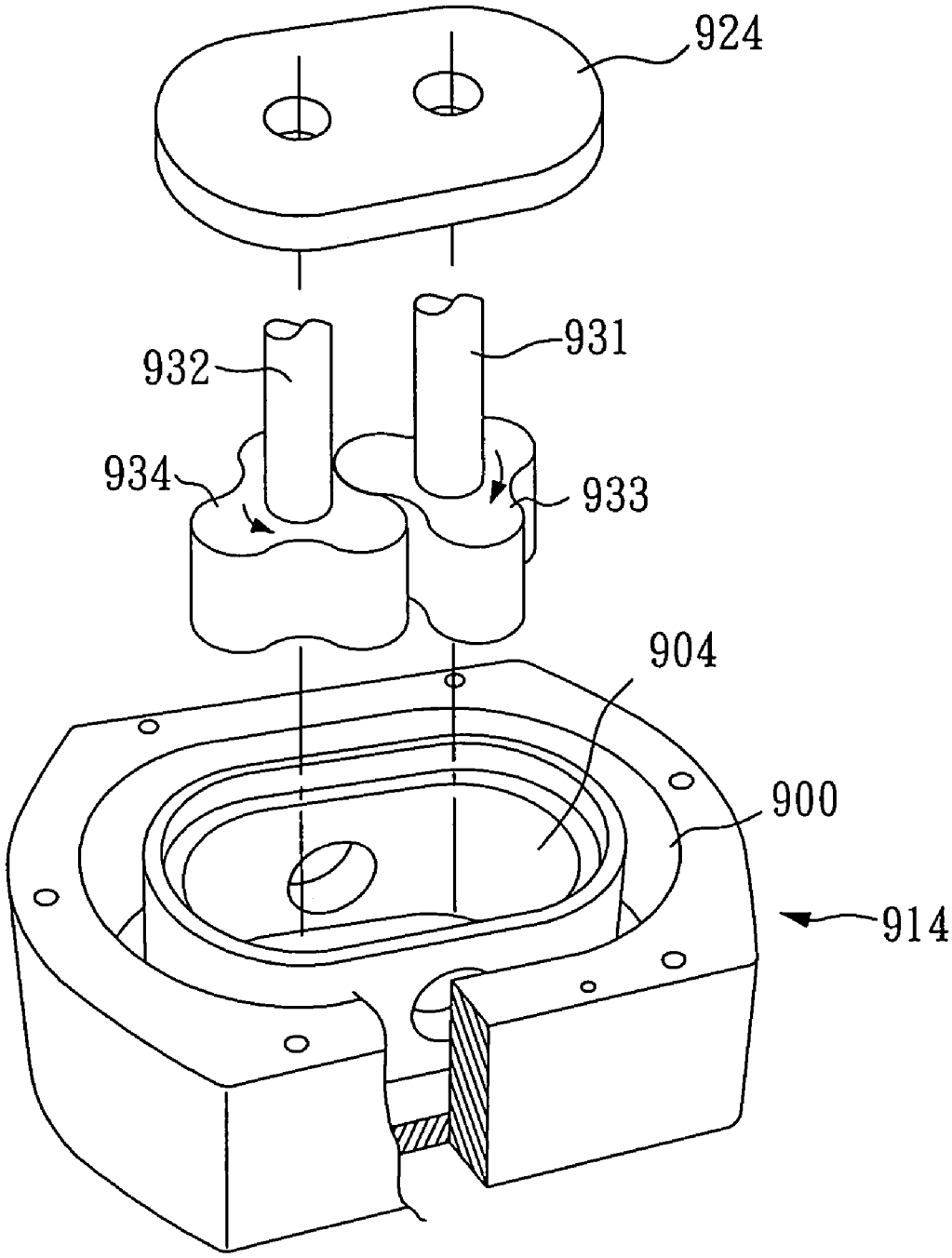
Fig. 2(Prior Art)
FIG. 2 is an exploded view of one pump unit of the multi-stage vacuum pump according to the prior art.
Figure 3:
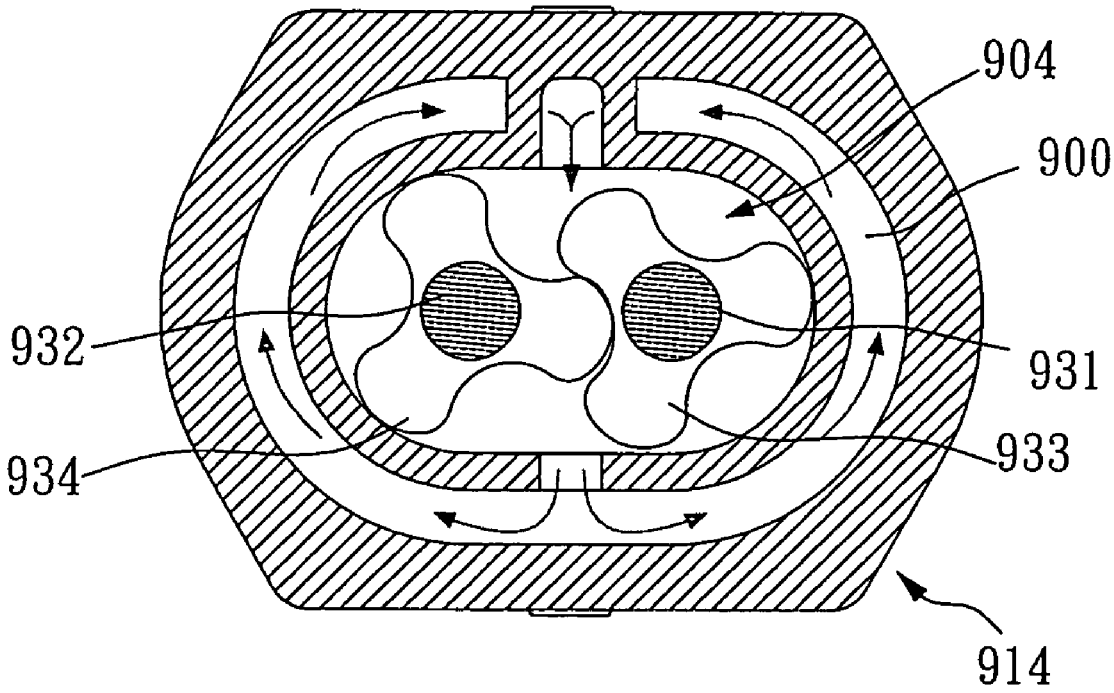
Fig. 3(Prior Art)
FIG. 3 is a top view in section of the pump unit shown in FIG. 2.
Figure 4:
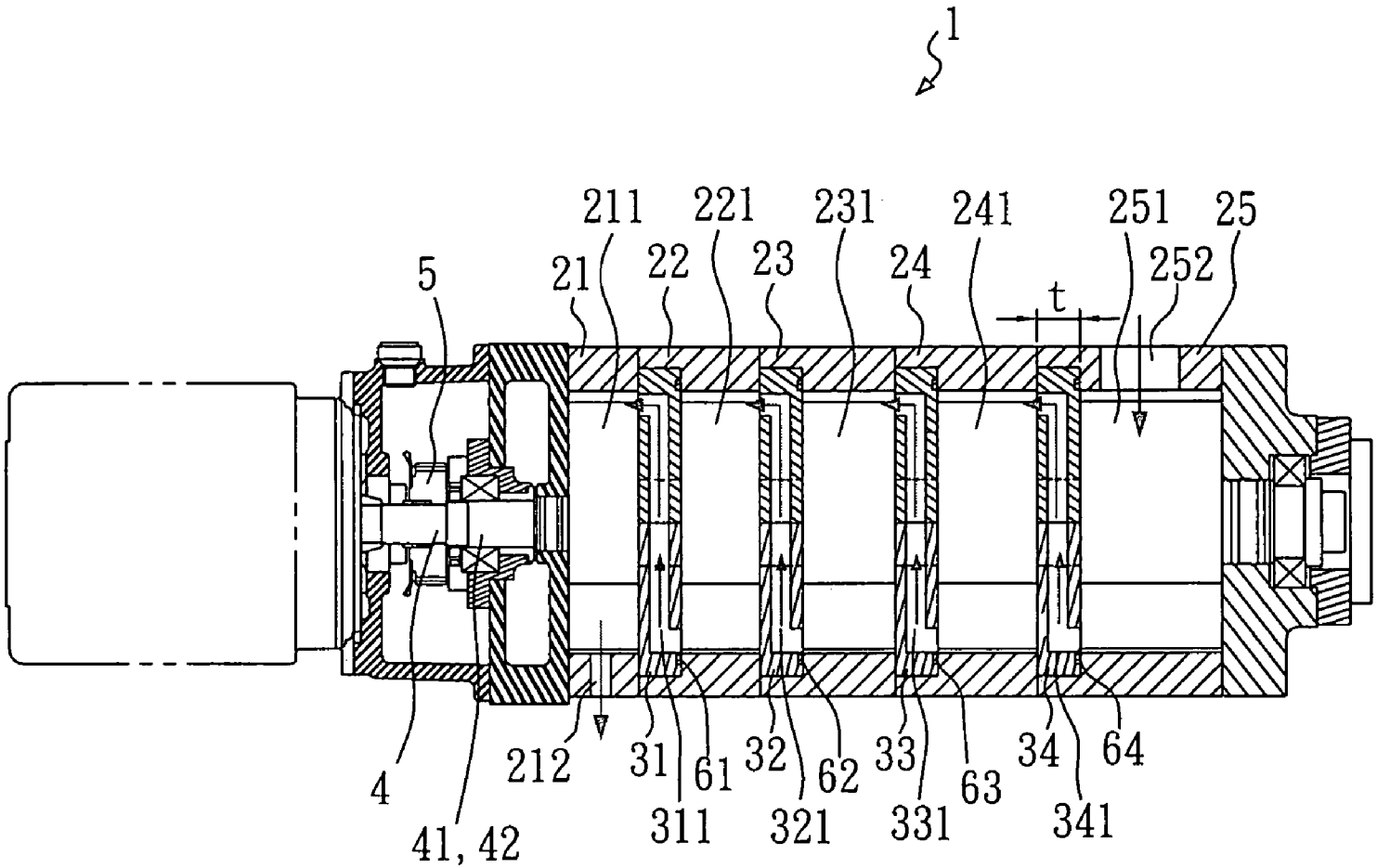
FIG. 4 is a sectional view of a multi-stage vacuum pump according to the present invention.

Referring to FIG. 4, a multi-stage vacuum pump 1 is shown comprised of a plurality of casings 21~25, a plurality of partition plates 31~34, and a mover module 4. The casings 21~25 are axially connected in series, each defining a respective compression chamber 211~251 inside thereof. The partition plates 31~34 each have a predetermined wall thickness "t", and each is respectively mounted between two adjacent casings 21~25 to separate the compression chambers 211~251 from one another.

Figure 5:
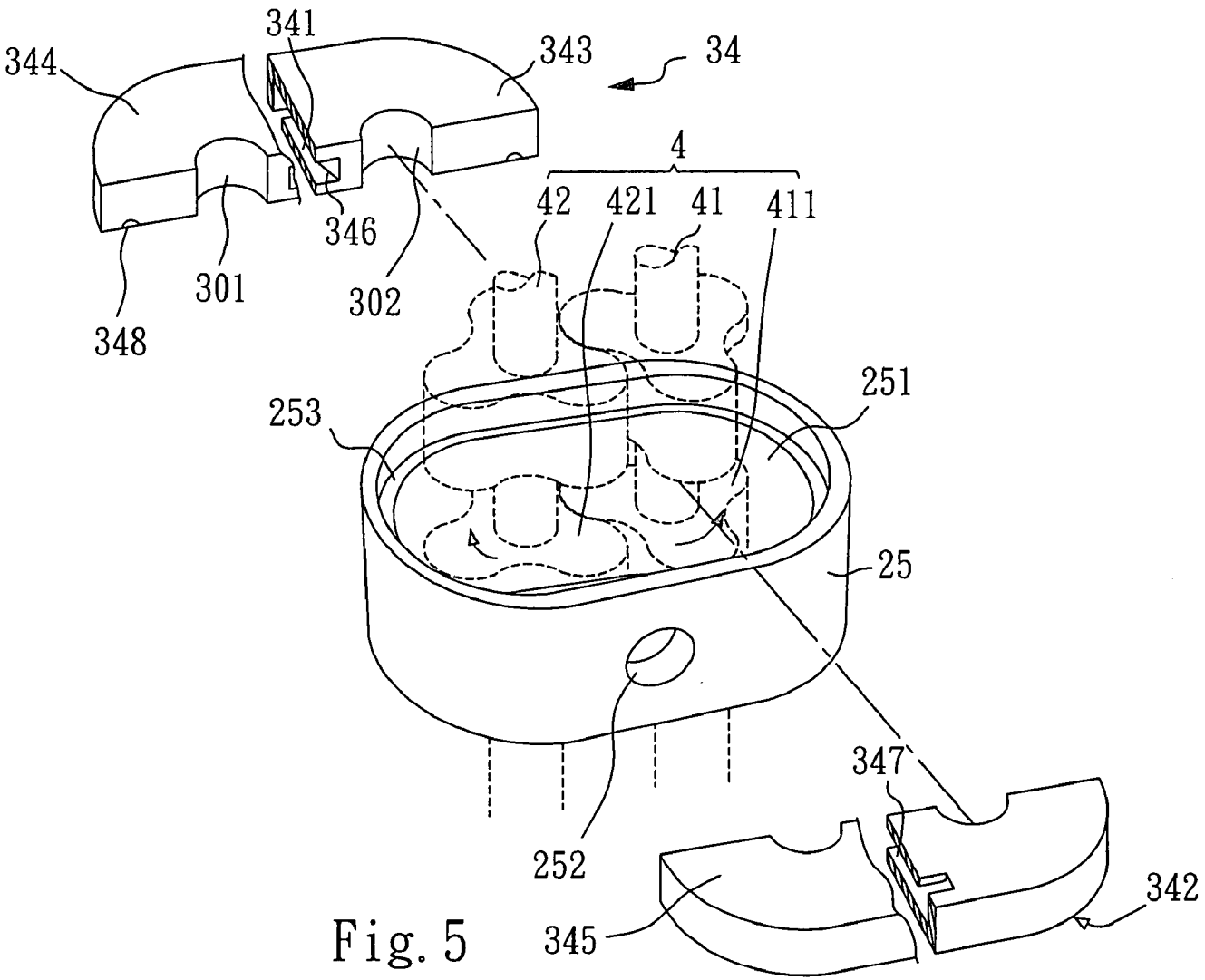
FIG. 5 is an exploded view of one vacuum pump stage of the multi-stage vacuum pump according to the present invention.
Figure 6:
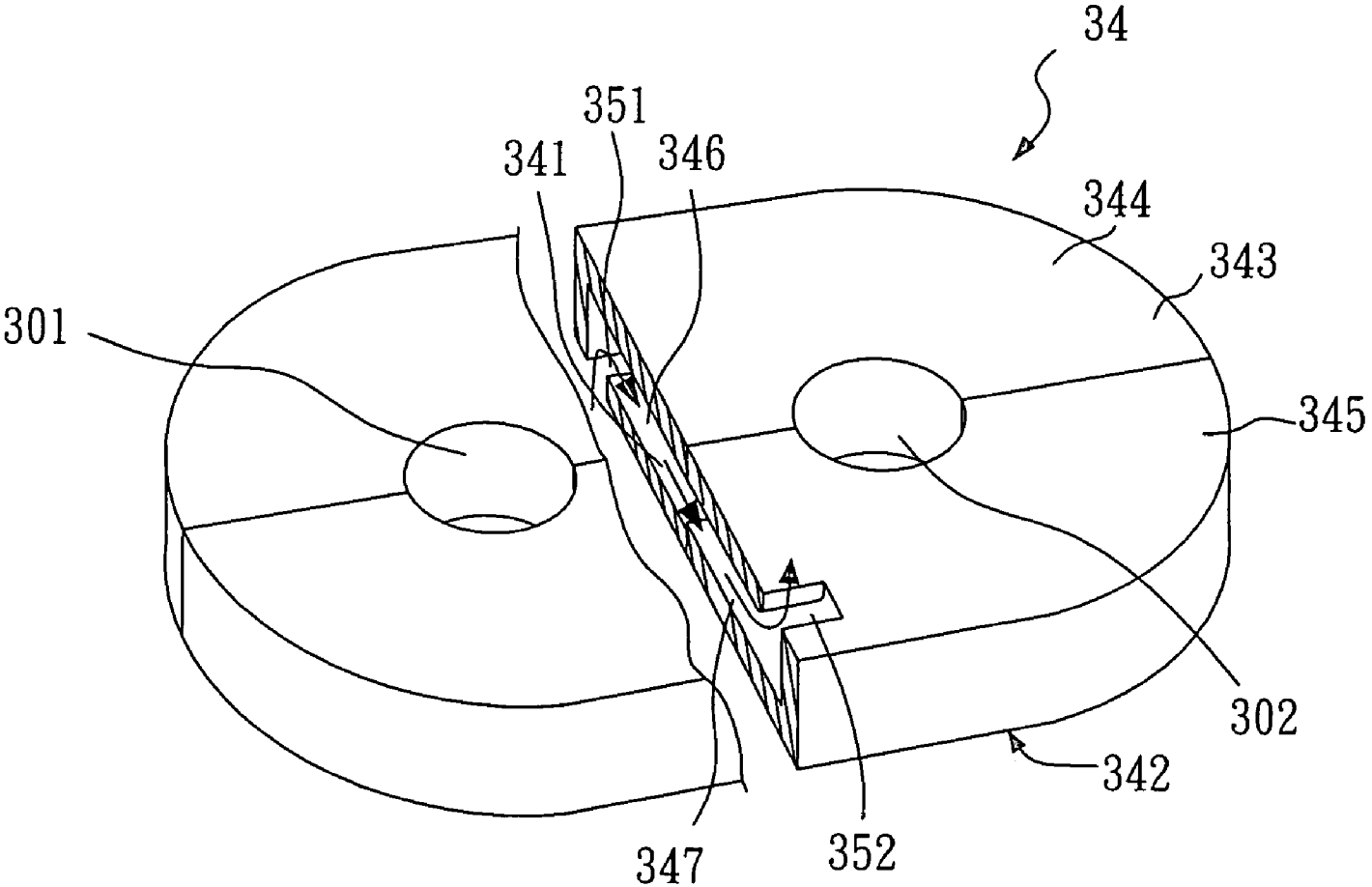
FIG. 6 is a perspective assembly view of the partition plate shown in FIG. 5.

Referring to FIGS. 5 and 6 and FIG. 4 again, the partition plates 31~34 are identical. FIGS. 5 and 6 show only one partition plate 34 for explanation. The partition plate 34 has two through holes 301 and 302. The aforesaid mover module 4 comprises two parallel shafts 41 and 42 suspended in the compression chambers 211~251 and respectively extended through the two through holes 301 and 302 of every partition plate 31~34, a plurality of rotors 411 and 421 respectively symmetrically formed integral with the two parallel shafts 41 and 42 respectively and arranged in pair, and each pair of the two adjacent rotors 411 and 421 received in one of the compression chambers 211~251 inside the casings 21~25, a synchronizer gear module 5 adapted to rotate the shafts 41 and 42 and the rotors 411 and 421 synchronously without causing a contact between each two adjacent rotors 411 and 421.

The partition plate 34 has a front face 342, a rear face 343, an air path 341 in the wall thickness t, a front opening 351 in the front face 342, and a rear opening 352 in the rear face 343. The rear opening 352 is in air-communication with the front opening 351 through the air path 341. According to this embodiment, the partition plate 34 is formed of a left partition plate member 344 and a right partition plate member 345. The left partition plate member 344 and the right partition plate member 345 are abutted against each other. The left partition plate member 344 defines therein a left air path 346. The right partition plate member 345 defines therein a right air path 347. The left air path 346 and the right air path 347 form the aforesaid air path 341. The air path 341 is formed in the partition plate 34 between the two through holes 301 and 302.

During operation, air passes through an air inlet 252 in the casing 25 into the corresponding compression chamber 251, and then compressed by the corresponding rotors 411 and 421 at the shafts 41 and 42. At this time, the compression chamber 251 forms a relatively high-pressure zone, and compressed air passes through the front opening 351 of the corresponding partition plate 34 into the air path 341 and then into the next compression chamber 241 via the rear opening 352. When compressed air passed out of the compression chamber 251 into the next compression chamber 241, the compression chamber 251 is changed from a high pressure status into a low pressure status. Thereafter, air in the next compression chamber 241 is compressed by the corresponding rotors 411 and 421 at the shafts 41 and 42, and forced to pass through the air path 331 of the next partition plate 33 to another next compression chamber 231. When repeatedly compressed in different compression chambers 211~251, finally compressed air flows out of the air outlet 212 of the casing 21.

As indicated above, when compressed in one compression chamber 221~251, compressed air directly passes through the air path 311~341 of the corresponding partition plate 31~34 to the next compression chamber 211~241. In comparison to the conventional air path design of extending around the border of each compression chamber, the casings 21~25 can be made relatively smaller than the conventional design without changing the capacity, i.e., the outer diameter and volume of the multi-stage vacuum pump 1 can effectively be reduced to lower the weight and the manufacturing cost.

Referring to FIGS. 4 and 5 again, the partition plate 34 has an annular groove 348, and an elastomer 64 mounted in the annular groove 348 (the other partition plates 31~33 have mounted therein a respective elastomer 61~63). After installation of the partition plate 34 in the corresponding case 25, the elastomer 64 seals the compression chamber 251, and absorbs the gap between the wall thickness t of the partition plate 34 and the corresponding mounting groove 253 at the casing 25, preventing occurrence of vibration noises.

Figure 7:
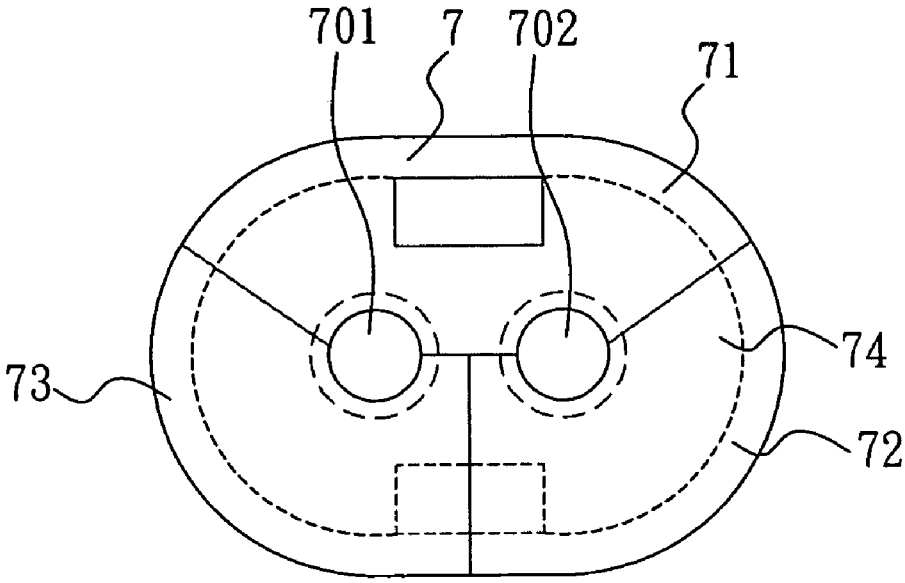
FIG. 7 is a schematic drawing showing an alternate form of the partition plate according to the present invention.

FIG. 7 shows an alternate form of the partition plate. According to this alternate form, the partition plate, referenced by 7, is comprised of three partition plate members 71~73 abutted against one another, and the air path 74 is formed surrounding the through holes 701 and 702 in the partition plate 7.

Figure 8:
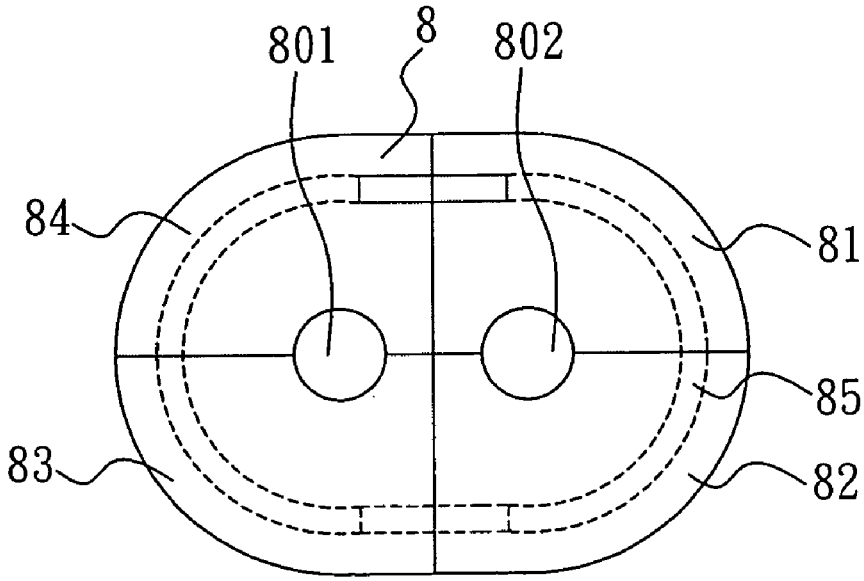
FIG. 8 is a schematic drawing showing another alternate form of the partition plate according to the present invention.

FIG. 8 shows another alternate form of the partition plate. According to this alternate form, the partition plate, referenced by 8, is comprised of four partition plate members 81~84 abutted against one another, and the air path 85 is formed surrounding the through holes 801 and 802 in the partition plate 8. The air path 85 can be made having a different size. Therefore, the partition plate according to the present invention is not limited to the composition of two partition plate members, i.e., the partition plate can be formed of multiple partition plate members abutted against one another. Further, the size of the air path can be properly changed.

Although the present invention has been explained in relation to its preferred embodiments, it is to be understood that many other possible modifications and variations can be made without departing from the spirit and scope of the invention as hereinafter claimed.

What is claimed is:

1. A multi-stage vacuum pump comprising: a plurality of casings axially connected in series, said casings each defining a compression chamber inside thereof;

a plurality of partition plates each respectively mounted between two adjacent casings of said plurality of casings to separate the compression chambers of said two adjacent casings, said partition plates each having a predetermined wall thickness and two through holes;

a mover module, said mover module comprising two parallel shafts respectively extended through the two through holes of each of said partition plates, and a plurality of rotors symmetrically formed integral with said two parallel shafts respectively and arranged in pairs, wherein each pair of two adjacent rotors of said plurality of rotors is received in one corresponding compression chamber of said casings; and a synchronizer gear module being driven to rotate said shafts and said rotors synchronously;

wherein said partition plates each have a front face, a rear face, and at least one air path respectively formed in the respective wall thickness and extended from said front face to said rear face; and wherein the at least one air path of each said partition plate is formed in between the two through holes of the respective partition plate.

2. The multi-stage vacuum pump as claimed in claim 1, wherein said partition plates each are comprised of a pair of partition plate members, said pair of partition plate members being abutted against each other, one of said partition plate members of said pair of partition plate members defining a first air path, another of said partition plate members of said pair of partition plate members defining second air path, said first air path and said second air path being linked to form one air path of the respective partition plate.

3. The multi-stage vacuum pump as claimed in claim 1, wherein said partition plates each further have an annular groove, and an annular elastomer respectively mounted in said annular groove and pressed on the corresponding casing to seal the compression chamber of the corresponding casing.

4. The multi-stage vacuum pump as claimed in claim 1, wherein said partition plates each have a front opening in the respective front face, and a rear opening in the respective rear face in air-communication with said front opening through the at least one air path of the respective partition plate.

5. The multi-stage vacuum pump as claimed in claim 4, wherein the front opening of each of said partition plates adapted to guide air into the at least one air path of the respective partition plate, and the rear opening of each of said partition plates adapted to guiding air out of the at least one air path of the respective partition plate.

6. The multi-stage vacuum pump as claimed in claim 1, wherein said partition plates each are comprised of four partition plate members abutted against one another.

7. The multi-stage vacuum pump as claimed in claim 1, wherein said synchronizer gear module drives said rotors and said shafts to rotate synchronously without causing contact between each two adjacent rotors.

* * * * *